US005752419A

United States Patent [19]

Liou

[11] Patent Number: 5,752,419

[45] Date of Patent: May 19, 1998

[54] PLIERS WITH AN INTEGRAL PIVOT

[76] Inventor: Mou-Tang Liou, No, 33, Hsi Hu Road, Da Lie City, Taichung Hsien, Taiwan

[21] Appl. No.: 800,573

[22] Filed: Feb. 18, 1997

[51] Int. Cl.[6] ..... B25B 7/04

[52] U.S. Cl. ..... 81/416; 81/412

[58] Field of Search ..... 81/415–417, 385, 81/393–394, 405–408, 411–413

[56] References Cited

U.S. PATENT DOCUMENTS

| | | | |
|---|---|---|---|
| 1,236,138 | 8/1917 | Bernard | 81/412 |
| 1,305,873 | 6/1919 | Briggs | 81/412 X |
| 1,643,835 | 9/1927 | Carlson | 81/412 |

*Primary Examiner*—D. S. Meislin
*Attorney, Agent, or Firm*—Charles D. Baxley, Esq.

[57] ABSTRACT

A pair of pliers includes a first plier member and a second plier member each including a jaw, an intermediate portion, and a handle portion. The intermediate portion of the second plier member includes an elongate slot having a narrowed section in a mediate portion thereof. The intermediate portion of the first plier member includes an integral stub formed on one side thereof which faces the intermediate portion of the second plier member. A pivot extends upwardly from the stub and extends through the elongate slot. A block is integrally formed on the side of the intermediate portion of the first plier member adjacent to the jaw of the first plier member, an engaging pin extending upwardly from the block. A cover plate is mounted to the first and the second piler members and includes two holes through which the engaging pin and the pivot extend, respectively. The engaging pin and the pivot are riveted to securely hold the first and the second plier members together.

1 Claim, 7 Drawing Sheets

PLIERS WITH AN INTEGRAL PIVOT

BACKGROUND OF THE INVENTION

1. Field of the Invention

The present invention relates to pliers with an integral pivot to provide a reliable structure to firmly grip objects.

2. Description of the Related Art

A pair of typical conventional pliers is shown in FIGS. 7 to 9 of the drawings. The pliers include a first plier member 10 and a second plier member 20. Each plier member 10, 20 includes a jaw 11, 21 having a teeth structure 111, 211 for gripping an object, an intermediate portion 13, 23, and a handle portion 12, 22. The intermediate portion 13 includes a first elongate slot 14 defined therein, wile the intermediate portion 23 includes a second elongate slot 24 having a narrowed section 241 in a mediate portion thereof. A bolt 15 is extended through the first elongate slot 14 and the second elongate slot 24 and fastened by a nut 25. The bolt 15 includes a flat stub 151 which is fittingly received in the first elongate slot 14, as shown in FIG. 9.

In operation, the plier members 10 and 20 pivot about the bolt 15, wherein the pivotal movements of the plier members 10 and 20 would not be smooth if the bolt 15 is too tight. However, if the bolt 15 is too loose, when gripping an object, the plier members 10 and 20 may rock and thus cannot reliably grip the object. In addition, when cutting an object, the object may be stuck if the bolt 15 is too loose. Furthermore, after a period of time of use, the bolt 15 and the nut 25 cannot provide a tight engagement therebetween such that the intermediate portions 13 and 23 may rock in a vertical direction and thus adversely affect the operation thereof. Additionally, the engagement between the bolt 15, the nut 25, and the intermediate portions 13, 23 is only a point contact such that the plier members 10 and 20 may rock and deviate and thus cannot provide a reliable torque during gripping or cutting.

Therefore, there has been a long and unfulfilled need for an improved plier structure which mitigates and/or obviates the above problems.

SUMMARY OF THE INVENTION

It is an object of the present invention to provide a pair of pliers which has a pivot integrally formed thereon to prevent undesired swivel.

A pair of pliers includes a first plier member and a second plier member each including a jaw, an intermediate portion, and a handle portion. The intermediate portion of the second plier member includes an elongate slot having a narrowed section in a mediate portion thereof. The intermediate portion of the first plier member includes an integral stub formed on one side thereof which faces the intermediate portion of the second plier member. A pivot extends upwardly from the stub and extends through the elongate slot. A block is integrally formed on the side of the intermediate portion of the first plier member adjacent to the jaw of the first plier member, an engaging pin extending upwardly from the block. A cover plate is mounted to the first and the second piler members and includes two holes through which the engaging pin and the pivot extend, respectively. The engaging pin and the pivot are riveted to securely hold the first and the second plier members together.

Other objects, advantages, and novel features of the invention will become more apparent from the following detailed description when taken in conjunction with the accompanying drawings.

DESCRIPTION OF THE PREFERRED EMBODIMENT

Figure 1:
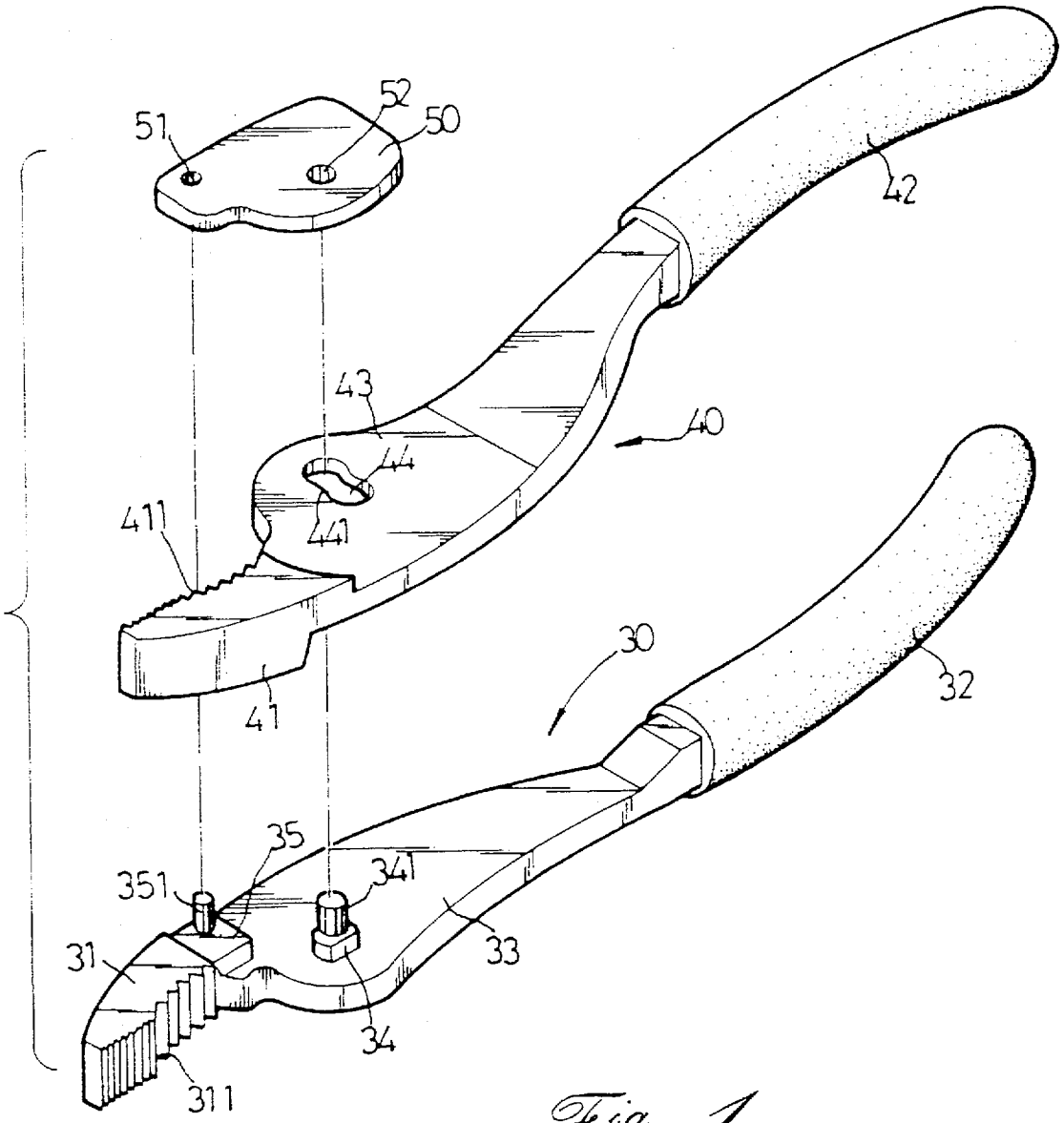
FIG. 1 is an exploded perspective view of a pair of pliers in accordance with the present invention.
Figure 2:
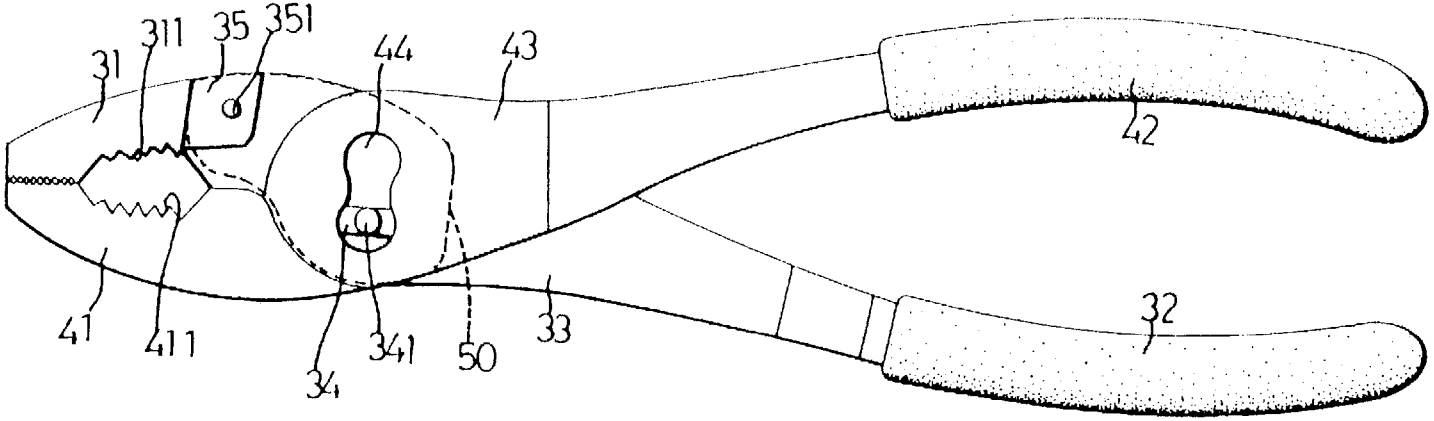
FIG. 2 is a top plane view of the pliers in accordance with the present invention.
Figure 3:
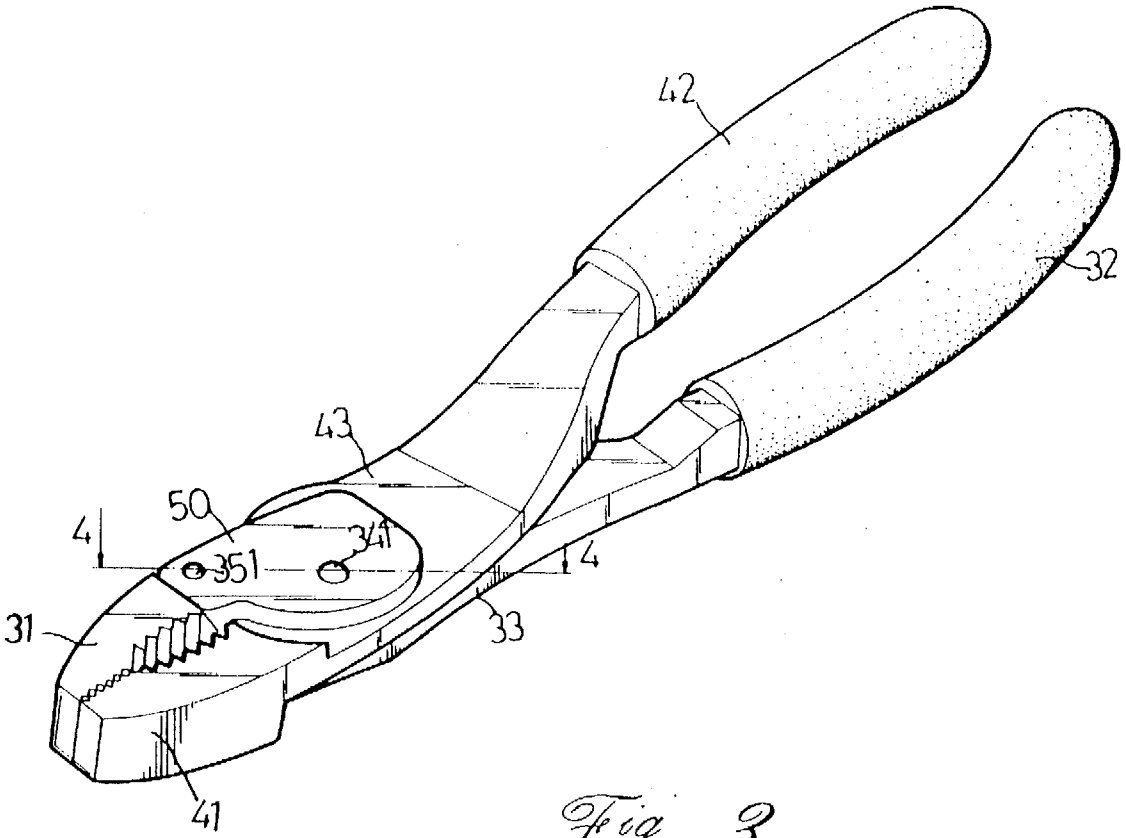
FIG. 3 is a perspective view of the pliers in accordance with the present invention.

Referring to FIGS. 1 to 6 of the drawings and initially to FIGS. 1 to 3, a pair of pliers in accordance with the present invention generally includes a first plier member 30 and a second plier member 40. Each plier member 30, 40 includes a jaw 31, 41 having a teeth structure 311, 411 for gripping an object, an intermediate portion 33, 43, and a handle portion 32, 42.

The intermediate portion 43 includes an elongate slot 44 having a narrowed section 441 in a mediate portion thereof. The intermediate portion 33 includes an integral stub 34 formed on one side thereof which faces the intermediate portion 43, and a pivot 341 extends upwardly from the stub 34. In addition, a block 35 is integrally formed on the side of the intermediate portion 33 adjacent to the jaw portion 31, and an engaging pin 351 extends upwardly from the block 35. A cover plate 50 includes two holes 51 and 52 through which the engaging pin 351 and the pivot 341 extend, respectively.

In assembly, the second plier member 40 is superimposed onto the first plier member 30 with the pivot 341 extending through the elongate slot 44. Thereafter, the cover plate 50 is mounted to the first and second plier members 30 and 40 in which the engaging pin 351 and the pivot 341 are respectively extended through the holes 51 and 52 (see FIG. 4). Then, the engaging pin 351 and the pivot 341 are punched and thus riveted. More specifically, the engaging pin 351 and the pivot 341 become rivets so as to securely hold the plier members 30 and 40 together.

Figure 5:
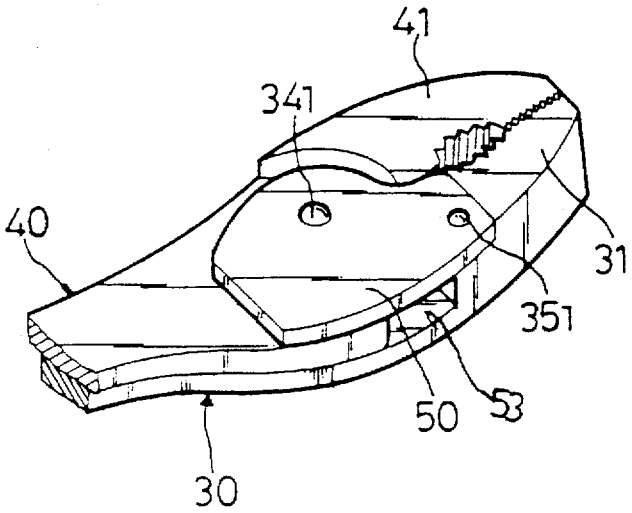
FIG. 5 is a partial perspective view of the pliers in accordance with the present invention.
Figure 4:
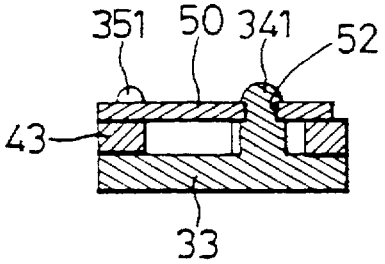
FIG. 4 is a cross sectional view taken along line 4—4 in FIG. 3.

Turning to FIG. 5, a gripping slot 53 is defined between the cover plate 50 and the first plier member 30. The slot 53 defines a space for pivotal movements of the second plier member 40 and keep the pivotal movements of the second plier member 40 stable without any rocking movements.

Figure 6:
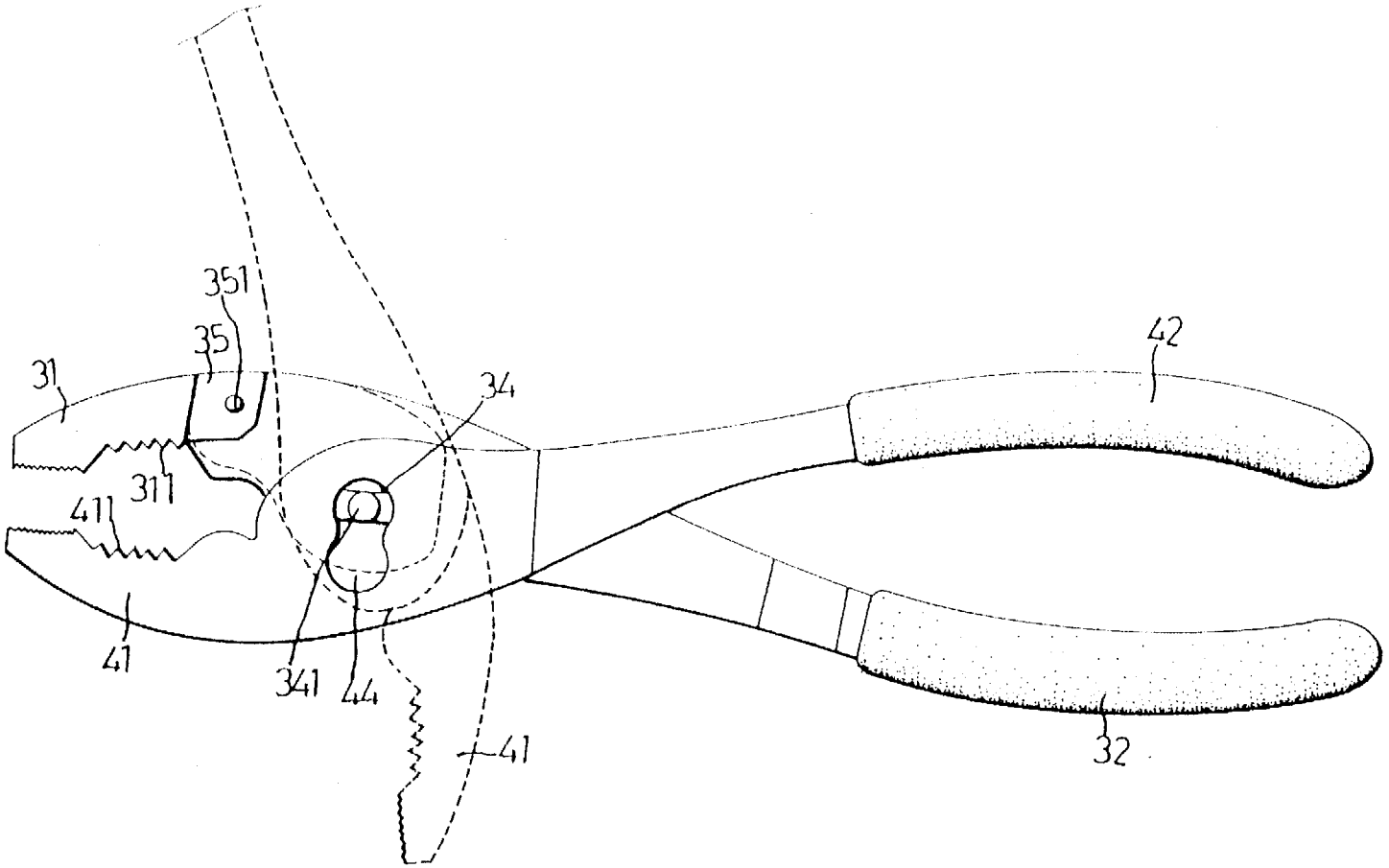
FIG. 6 is a top plane view illustrating operation of the pliers in accordance with the present invention.
Figure 7:
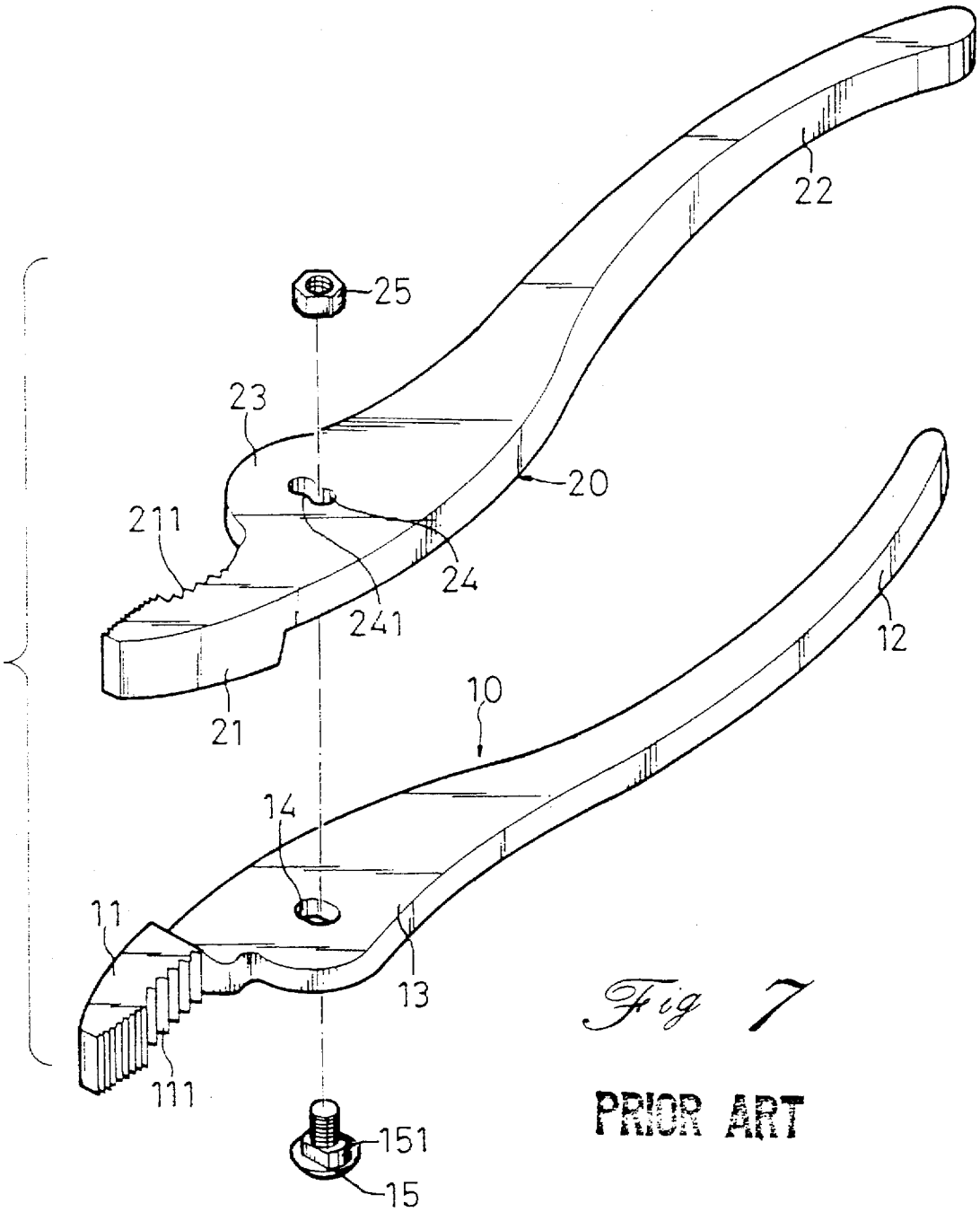
Fig 7 PRIOR ART
FIG. 7 is an exploded perspective view of a pair of conventional pliers.
Figure 8:
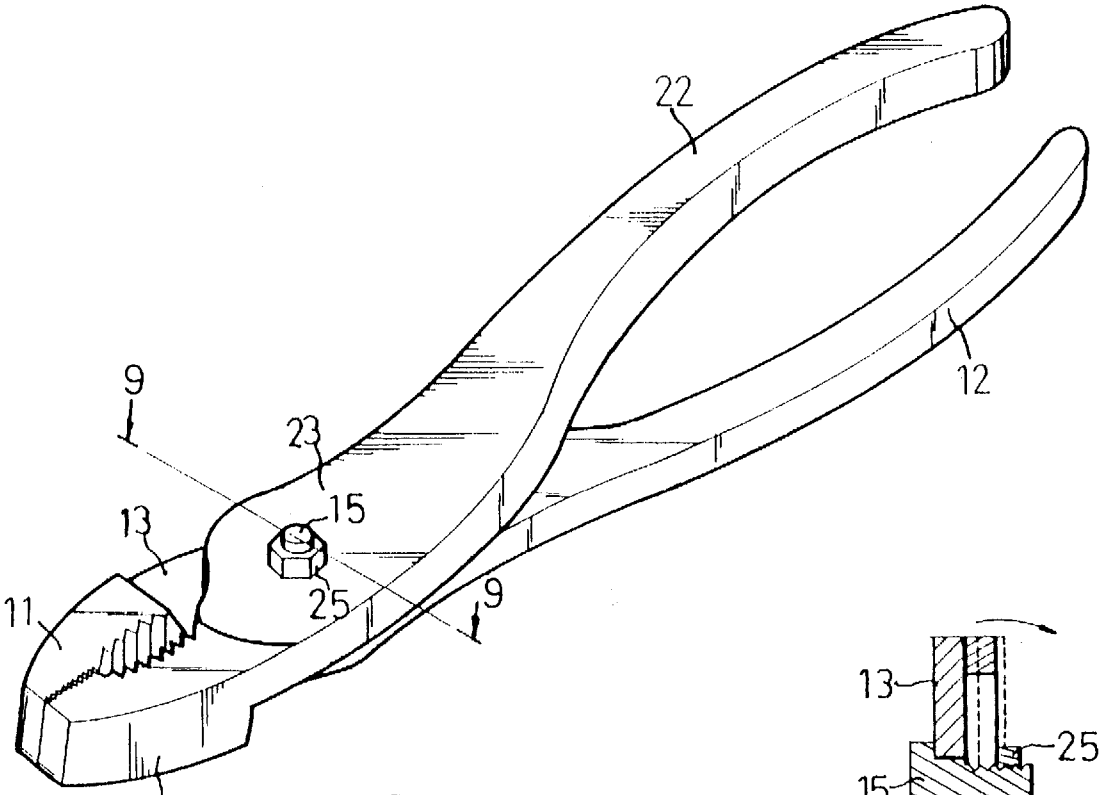
Fig 8 PRIOR ART
FIG. 8 is a perspective view of the conventional pliers.
Figure 9:
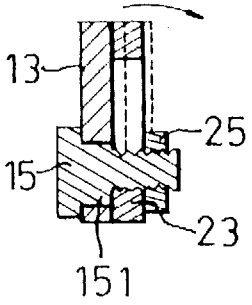
Fig 9 PRIOR ART
FIG. 9 is a cross sectional view taken along line 9—9 in FIG. 8.

Referring to FIG. 6, in operation, as shown by the phantom lines, the second plier member 40 is pivoted toward the block 35 and then shifted by a small distance such that the pivot 341 is received in the other end of the elongate slot 44, thereby allowing the pliers to grip objects of different sizes, which is conventional and therefore not further described.

According to the above description, it is appreciated that the pivot 341 and the engaging pin 351 are integrally formed on the plier member 30 such that rocking movements and undesired displacements of the plier members of conventional designs can be avoided, thereby providing a reliable torque for gripping and cutting. In addition, the first and second plier members 30 and 40 will not disengage from each other and thus have a longer period of life. Furthermore, the cover plate 50 may keep the second plier member 40 stable and restrain the pivotal movements of the second plier member 40, while the cover plate 50 and the second plier member 40 have a surface contact to prevent rocking movements of the second plier member 40.

Although the invention has been explained in relation to its preferred embodiment, it is to be understood that many other possible modifications and variations can be made without departing from the spirit and scope of the invention as hereinafter claimed.

What is claimed is:

1. A pair of pliers, comprising:

a first plier member and a second plier member each including a jaw, an intermediate portion, and a handle portion, the intermediate portion of the second plier member including an elongate slot having a narrowed section in a mediate portion thereof, the intermediate portion of the first plier member including an integral stub formed on one side thereof which faces the intermediate portion of the second plier member, a pivot extending upwardly from the stub and extending through the elongate slot, a block being integrally formed on the side of the intermediate portion of the first plier member adjacent to the jaw of the first plier member, an engaging pin extending upwardly from the block, a cover plate being mounted to the first and the second piler members and including two holes through which the engaging pin and the pivot extend, respectively, the engaging pin and the pivot being riveted to securely hold the first and the second plier members together.

* * * * *